US005632050A

United States Patent [19]

Zajas et al.

[11] Patent Number: 5,632,050

[45] Date of Patent: May 27, 1997

[54] BODY AND HEAD SUPPORT PLATFORM

[76] Inventors: Paul J. Zajas; Mary E. Zajas, both of 58 Merrimack Dr.; Thomas P. Adams; Paulette Adams, both of 10 Kyle Rd., all of Merrimack, N.H. 03054

[21] Appl. No.: 511,023

[22] Filed: Aug. 3, 1995

[51] Int. Cl.[6] ..... A47C 20/00; A47C 20/08

[52] U.S. Cl. ..... 5/632; 5/638; 5/640; 5/725; 5/922

[58] Field of Search ..... 5/632, 630, 638, 5/465, 420, 922, 636, 640, 733, 722, 723, 725

[56] References Cited

U.S. PATENT DOCUMENTS

| | | | |
|---|---|---|---|
| D. 271,834 | 12/1983 | Huntsinger | D6/601 |
| D. 277,059 | 1/1985 | Boone | D6/601 |
| D. 309,542 | 7/1990 | Glenn | D6/596 |
| D. 337,914 | 8/1993 | McDonald | D6/601 |
| 1,171,713 | 2/1916 | Gilkerson . | |
| 2,579,783 | 3/1951 | Branto . | |
| 2,926,660 | 4/1960 | Thompson . | |
| 3,140,497 | 7/1964 | Carswell | 5/638 |
| 3,808,615 | 5/1974 | Geary . | |
| 4,333,638 | 6/1982 | Gillotti | 108/36 |
| 4,752,064 | 6/1988 | Voss | 5/638 |
| 4,757,983 | 7/1988 | Ray et al. | 5/638 |
| 4,779,297 | 10/1988 | Sturges | 5/638 |
| 4,843,662 | 7/1989 | Handelman | 5/420 |
| 4,881,728 | 11/1989 | Hunter . | |
| 4,987,625 | 1/1991 | Edelson | 5/420 |
| 5,054,142 | 10/1991 | Owens | 5/465 |
| 5,177,823 | 1/1993 | Riach | 5/636 |
| 5,269,035 | 12/1993 | Hartunian | 5/638 |
| 5,360,017 | 11/1994 | Austin | 5/640 |
| 5,491,851 | 2/1996 | Alonso | 5/420 |

*Primary Examiner*—Alexander Grosz

*Attorney, Agent, or Firm*—Wigman, Cohen, Leitner & Myers, P.C.

[57] ABSTRACT

A body support platform comprises a foldable body support cushion formed of two wedge-shaped cushions covered with a washable fabric covering forming a hinge at which the cushion is folded. A head support cushion comprising three covered cushion components detachably affixed at one end of the body support cushion. The coverings of the body and head support cushions each have a pair of overlapping flap portions for inserting and removing foam elements into the coverings. The flap portions of the body support cushion also form a pair of pockets in the sides of the folded body support cushion for carrying the cushion components of the head support cushion and an ankle supporting bolster. A handle is provided adjacent the hinge for carrying the body support platform in its folded state.

25 Claims, 2 Drawing Sheets

BODY AND HEAD SUPPORT PLATFORM

FIELD OF THE INVENTION

The present invention relates to body support platforms and more particularly to a portable cushioning system for supporting the head and body of a person in a comfortable and proper position for massage therapy, exercise and recreational use, relaxation and the like.

BACKGROUND OF THE INVENTION

There are a number of prior art beds, pillows, cushioning devices and platforms for supporting the head and body of a person for various therapeutic and recreational purposes. Some examples of such prior art devices are disclosed in the following U.S. patents:

| | | |
|---|---|---|
| 1,171,713 | 4,752,064 | Des. 271,834 |
| 2,579,783 | 4,757,983 | Des. 277,059 |
| 2,926,660 | 4,881,728 | Des. 298,992 |
| 3,808,615 | 5,177,823 | Des. 309,542 |
| 4,333,638 | 5,269,035 | Des. 337,914 |

The prior art devices disclosed in the above-listed patents have a number of drawbacks and disadvantages that render their use less than optimum. In particular, U.S. Pat. Nos. 2,579,783; 4,333,634 and 4,881,728 disclose foldable and portable therapeutic devices for supporting the body and head of a person. Those prior art devices are relatively complex, heavy and cumbersome and have a number of rigid foldable and pivotable members which can subject the user to injury from pinching, from sharp corners and the like.

A number of the prior art head cushions or pillows disclosed in the aforementioned patents are relatively complex molded shapes requiring special molds and tooling for fabricating the cushions. In some cases, such cushions are not universally sized so that they can accommodate users of all body sizes. U.S. Pat. Nos. 4,752,064; 4,757,983; 5,269,035; D271,834; D277,059; D298,992 and D337,914 are representative of such specially made or molded head cushions or pillows.

A further drawback of the aforementioned prior art devices is the lack of readily washable, hygienic coverings for the head and body cushions. The prior art body support cushions made of uncovered closed or open-cell flexible foams are not particularly hygienic, especially in applications where there may be significant body perspiration, such as exercise and recreational applications.

In view of the foregoing, it would be desirable to provide a portable lightweight, hygienic body support platform which may be quickly and safely assembled for use on any planar surface, such as the ground, a floor, table, or bed.

SUMMARY OF THE INVENTION

The present invention is directed to a body and head support platform that overcomes the foregoing limitations and shortcomings of the prior art devices, as well as other disadvantages of those devices not specifically mentioned above. In particular, the body support platform of the invention comprises a plurality of specially shaped flexible foam cushions which are positioned and fixed in operative relationship to one another by means of washable coverings for the cushions and releasable fasteners, such as hook-and-loop fasteners. The washable coverings may be made, for example, from a soft fabric material, preferably, a somewhat stretchable or elastic cotton-based fabric. Other types of coverings may be used for the cushions, depending on the particular application contemplated. If, for example, the body and head platform of the invention is to be used in an outdoor environment, such as a sandy beach, a slightly elastic plastic or rubberized fabric covering may be preferred. The coverings are especially designed to be readily removable from the foam cushions so as to permit them to be machine washed or cleaned whenever necessary.

The covered body support cushions of the platform comprise two wedge-shaped foam cushions adapted to be folded along a fabric hinge into a rectangular parallelepiped shape for carrying by means of a strap or handle affixed to the cushion covering adjacent the fabric hinge. The head support cushion comprises three fabric-covered rectangular parallelepiped cushions each provided with fasteners, such as hook-and-loop fasteners, for assembling the three individual cushions into the head support cushion. Hook-and-loop fasteners may also be used to fasten the head support cushion to one end of the body support cushion. One of the three individual cushions that make up the assembled head support cushion is provided with a generally oval or elliptical through opening into which the face of the user may be placed. The opening in the assembled head support cushion permits the user to breath freely while lying face down in the prone position. A further fabric-covered foam cushion or bolster, preferably having a cylindrical shape, is provided for supporting the ankles of the user in the prone position so that the feet may be extended and supported without having to turn or splay them to one side or the other in a less comfortable position. This ankle support bolster is not connected to the body or head support cushions, but is adapted to be freely positionable relative to those other cushions to accommodate users of substantially all heights and body sizes. Additional bolsters may also be employed for other purposes, such as for abdominal support or for support of any other body part to achieve a more natural body position.

The face down or prone position is a most desirable position for avoiding stress on the neck and vertebrae, especially during massage therapy and other musculoskeletal manipulation procedures. That position is also one of the most comfortable for the human body and helps to avoid neck ache and backache. The body and head support platform of the invention may also be used to support the head and body in the face up or supine position with the back of the head located in the oval opening of the head support cushion. Use of the body and head support platform of the invention in both the prone and supine positions is particularly advantageous in the recreational application of sunbathing or the like.

The fabric covering of the two wedge-shaped body support cushions is provided with overlapping fabric portions or flaps on two of the large area surfaces of the cushions. It is through these overlapping flaps that the two wedge-shaped foam body support cushions are inserted and removed. Advantageously, the two flaps are located on the outermost surfaces of the body support platform when the two cushions are folded into the transportable rectangular parallelepiped configuration. The edges of the outer fabric flaps are both positioned in close proximity to the fabric hinge and handle so that when the body support portion is transported by its handle in the folded, portable condition, each flap forms an upwardly open pocket or receptacle on a respective side of the body support cushions. The two pockets thus formed are advantageously used to receive the three piece head support cushion and the ankle support bolster for transporting the entire body and head support platform assembly from place-to-place in its unassembled state by one hand in a manner similar to carrying a small, lightweight piece of luggage.

With the foregoing and other objects, advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
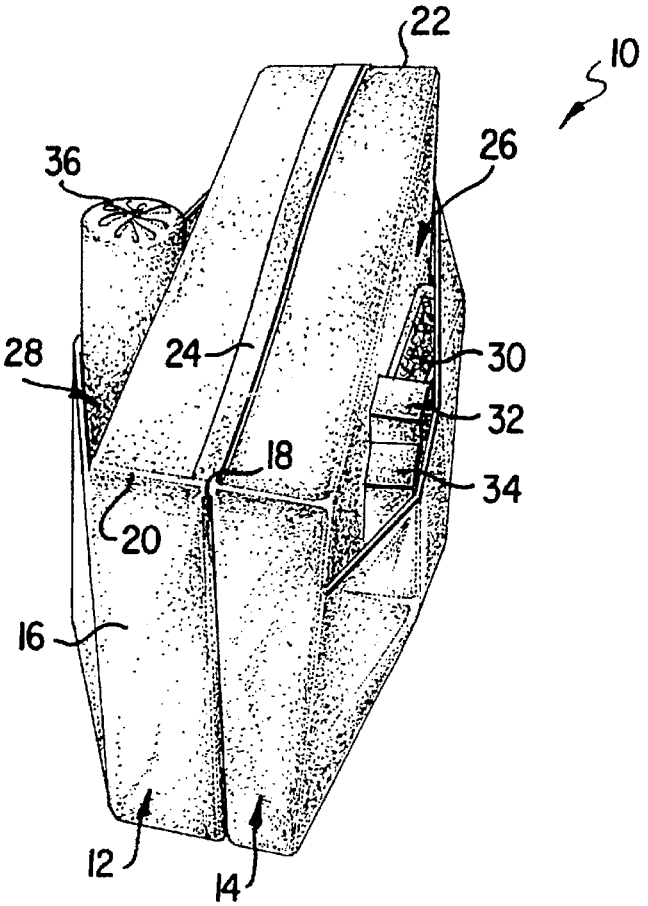
FIG. 1 is a perspective view of the body and head support platform of the present invention showing the platform in its disassembled, transportable condition.

Referring now in detail to the drawings, there is illustrated in the FIG. 1 perspective view the body and head support platform of the present invention in its folded, transportable configuration and designated generally by reference numeral 10. As seen in FIG. 1, the platform 10 comprises two wedge-shaped foam cushion components 12, 14 covered with a unitary covering 16, which may be a somewhat elastic sheet material, such as a cotton-based stretchable fabric, a resilient plastic or rubberized fabric, leather or the like.

The covering is folded along a flexible hinge 18 formed of the covering material and extending the width of the cushions 12, 14 between the side edges 20, 22 thereof so that the two cushions 12, 14 form a generally rectangular parallelepiped. A strap handle 24 is secured to the covering 16 of the cushions adjacent to the hinge 18 for carrying the platform 10 in the manner of luggage. The strap handle preferably extends the full width of the cushions 12, 14 and is secured at the side edges 20, 22 of the cushions, but may have a shorter length, if desired.

The covering 16 is constructed by sewing (if a fabric material) as will be described in more detail hereinafter with two upwardly open flap pockets or receptacles 26, 28 on opposite sides of the folded platform 10. Pockets 26, 28 are formed by overlapping portions of the covering 16. Pocket 26 contains three covered foam cushion components 30, 32, 34 that are assembled into a head support cushion as described hereinafter. Pocket 28 contains one or more covered cylindrical foam bolsters 36. It will be appreciated by those skilled in the art that the platform 10 in its folded configuration shown in FIG. 1 may be readily transported from place-to-place with a minimum of effort. The foam material used to fabricate the various cushion components 12, 14, 30, 32, 34, 36 is preferably a polymeric foam, such as a soft, open-celled urethane foam, or any other suitable foam with a softness or hardness selected for the particular application of the platform. Now referring to FIG. 2, the body and head support platform 10 of the invention is shown in its unfolded, operative configuration. It will be seen that the cushion components 30–36 have been removed from the pockets 26, 28 and the two wedge-shaped cushions 12, 14 have been unfolded along hinge 18 to form a body support cushion 40 which is placed upon a flat surface, such as the ground, a floor, a table or other planar surface G. In one example of the embodiment shown in FIG. 2, the unfolded body support cushion 40 is about 32 inches long, about 22 inches wide and tapers from a thickness of about 2½ inches at its thinner end to about 5½ inches at its thicker end. The bolster 36 for this embodiment is about 5 inches in diameter and about 22 inches long. Other dimensions of the cushions are, of course, contemplated by the invention.

Figure 2:
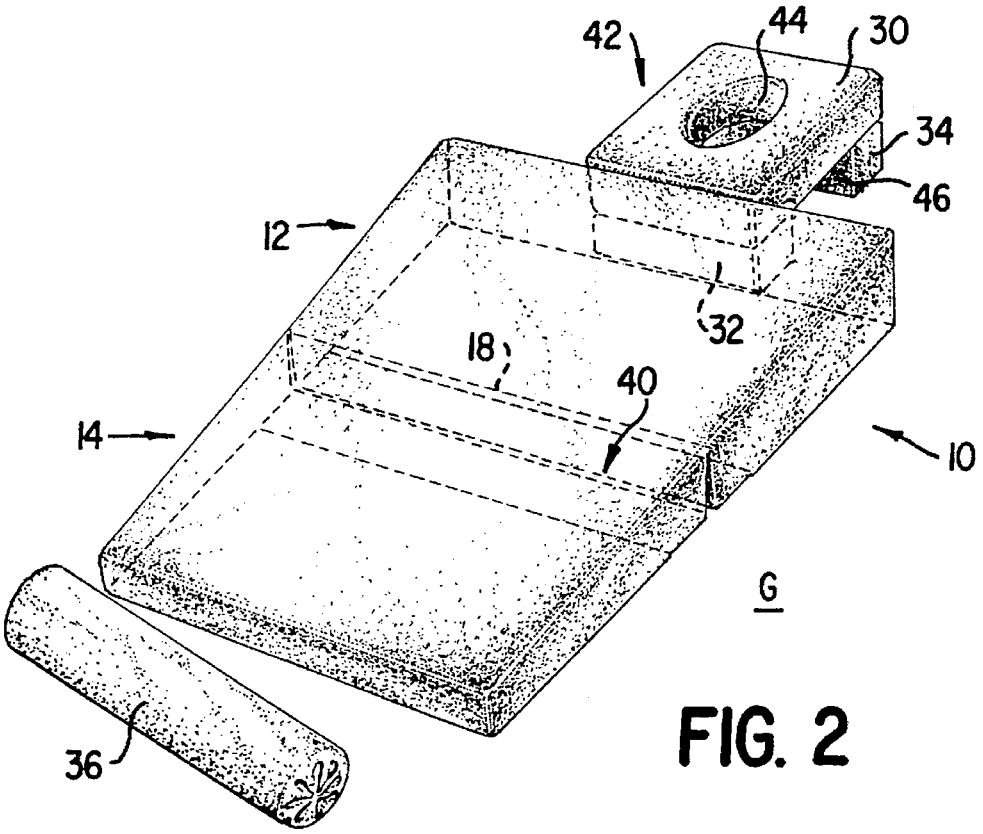
FIG. 2 is a perspective view of the body and head support platform of the present invention showing the platform in its assembled, operative condition.

The cushions 30–34 are assembled into a head support cushion 42 as shown in FIG. 2 by means of hook-and-loop fasteners which are not shown in FIG. 2. Cushion 30 is provided with a central oval opening 44 into which the face of a user is placed when the user lies upon the cushions 40, 42, 36 in the face down or prone position. The cushions 32, 34 space the cushion 30, and thus the nose and mouth of the user, off the surface G and provide a transverse breathing passage 46 for the user. In one example of the embodiment of the head support cushion shown in FIG. 2, the cushion 30 is about 12 inches long, about 10 inches wide and about 2½ inches thick; the cushions 32, 34 are about 3 inches by 3 inches in cross-section and about 10 inches long thereby providing an adequate breathing passage of about 6 inches by 3 inches. The dimension of the oval opening along its major axis is about 7½ inches by about 3½ inches. Other dimensions of the head support cushions 30, 32, 34 are contemplated by the invention.

Figure 3:
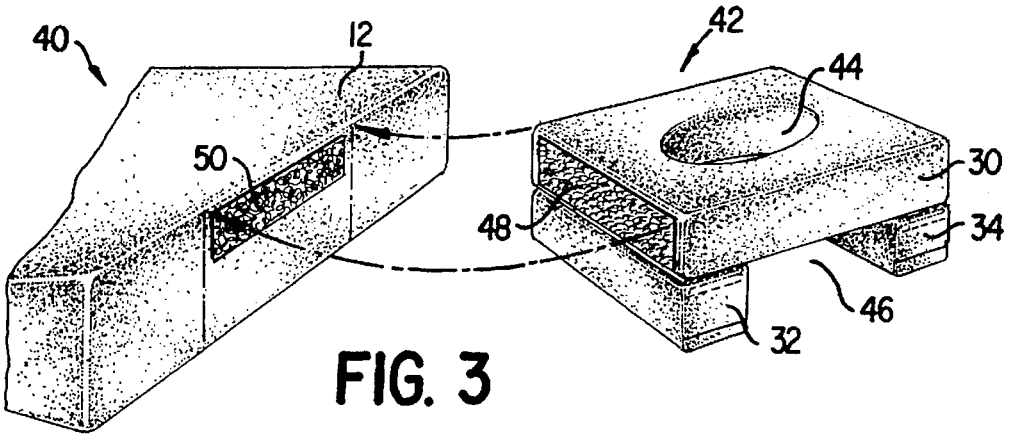
FIG. 3 is a fragmentary perspective view of the body and head support platform of the present invention showing the manner in which the head support cushion is assembled to one end of the body support cushion.

FIG. 3 illustrates the manner in which the head support cushion 42 is attached to the body support cushion 40 by means of hook-and-loop fastener strips 48, 50. Other types of fasteners may be used to detachably secure the components of the invention together, e.g., snap fasteners, slide fasteners and the like.

Figure 4:
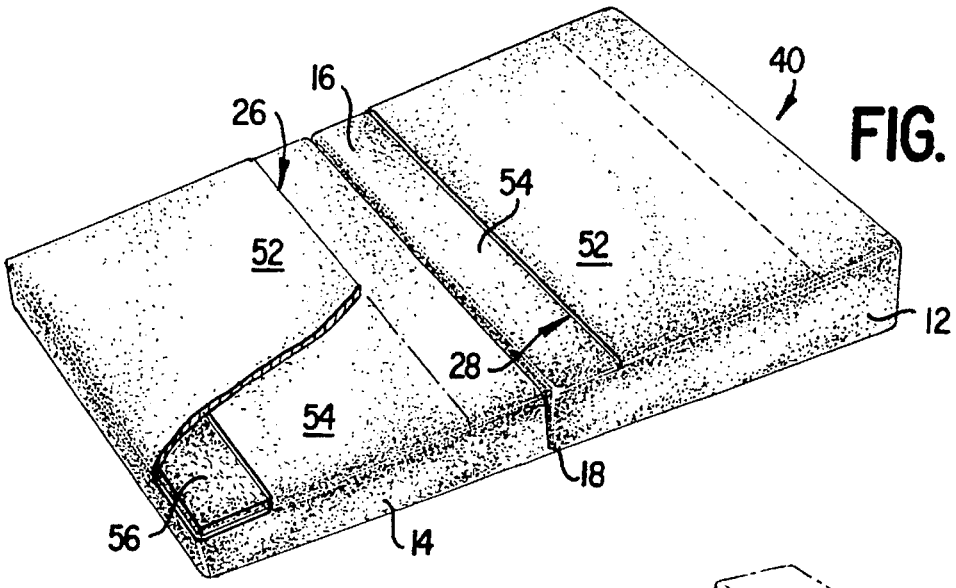
FIG. 4 is a fragmentary perspective view of the body support cushion of the present invention showing the overlapping flaps through which the foam cushions are inserted into and removed from their coverings.

In FIG. 4 there is illustrated the construction of the covering for the two cushions 12, 14 of the body support cushion 40. The surface of cushion that is intended to rest upon the surface G (FIG. 2) is uppermost in FIG. 4 so as to show the arrangement of the two pair of overlapping flap portions 52, 54 of the covering 16 which form the two pockets 26, 28 for receiving the head support cushion components 30–34 and bolster 36. The wedge-shaped foam elements 56 (only one shown) are inserted and removed from the covering 16 through the opening provided between the overlapping flap portions 52, 54. These openings not only provide means for removing and replacing the foam elements 56, but also advantageously provide the pockets 26, 28 for transporting the cushions 30–34 and bolster 36. The extent of the overlap of the flap portions 52, 54 may be varied depending primarily on the elasticity of the covering, i.e., the greater the elasticity of the covering, the greater the possible overlap.

Figure 5:
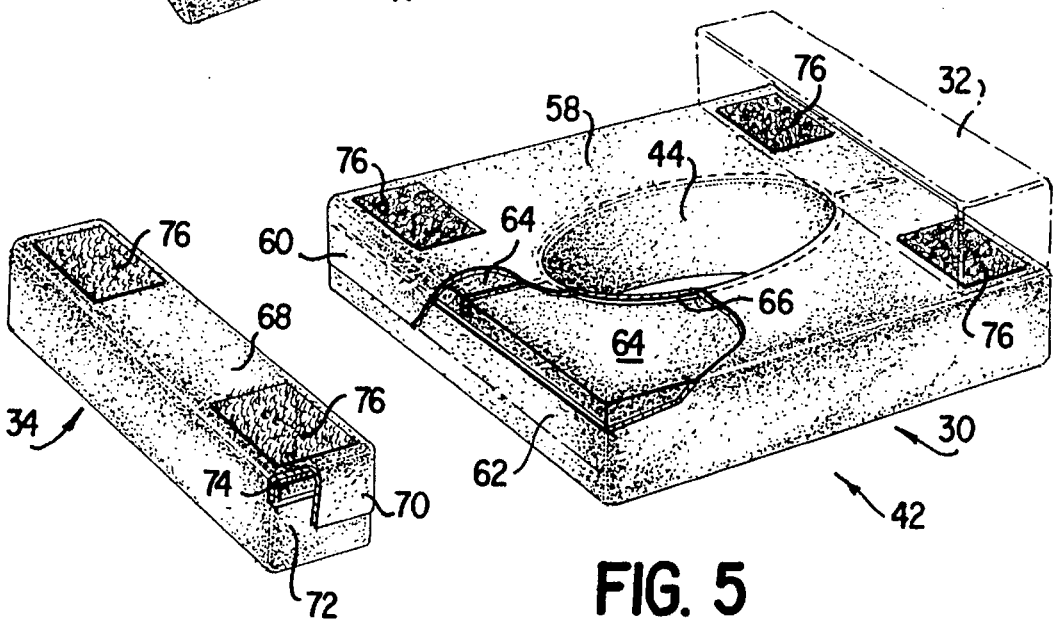
FIG. 5 is a fragmentary perspective view of the three-piece head support cushion of the present invention showing the overlapping flaps through which the foam cushions are inserted into and removed from their coverings and the manner in which the three covered cushions are assembled.

FIG. 5 illustrates a preferred construction of the head support cushion 42. The covering 58 for cushion 30 is preferably fabricated with overlapping flap portions 60, 62 at one end of the cushion 30 through which two identical foam elements 64 may be inserted and removed. Foam elements 64 are rectangular parallelepipeds with a half- or semi-oval cutout 66 along one long side thereof to accommodate the oval opening 44 sewn in the covering 58.

Each of the cushion components 32, 34 is provided with a covering 68 having at one end of the cushion overlapping flap portions 70, 72 through which a foam element 74 may be inserted and removed. Hook-and-loop fasteners 76 are provided on the cushions 30, 32 and 34 for securing the cushions 32 and 34 to the underside of cushion 30 in the manner shown in FIGS. 3 and 5. The covering for the bolster 36 may be constructed in the same way as the coverings for the other cushion components, that is, with overlapping flap portions on the side or one end of the bolster. While the preferred form of the coverings of the invention are provided with overlapping flap portions for inserting and removing the foam elements, it would also be possible to use other means for accomplishing that objective, such as slide fasteners, for example.

Although certain presently preferred embodiments of the invention have been described herein, it will be apparent to those skilled in the art to which the inventions pertains that variations and modifications of the described embodiment may be made without departing from the spirit and scope of the invention. Accordingly, it is intended that the invention be limited only to the extent required by the appended claims and the applicable rules of law.

We claim:

1. A body support platform comprising at least one pair of cushion components, a covering for said pair of cushion components, said covering comprising a hinge between said cushion components for folding said cushion components into a folded condition having a predetermined shape for transporting said platform and for holding said cushion components in an operative condition in an unfolded relationship relative to one another, said covering having at least a first pair of overlapping flap portions forming a first pocket in said covering, said flap portions being separate from said hinge and spaced therefrom, a head support cushion detachably affixed to one of said cushion components, said head support cushion comprising at least one cushion component having an opening therethrough for receiving the face of a user, a breathing passage in said head support cushion communicating with said opening for permitting the user to breathe, said head support cushion being detachable from said one cushion component so as to be received in said first pocket for transporting thereof in the folded condition of said pair of cushion components.

2. The body support platform of claim 1, wherein said head support cushion comprises three head support cushion components, said opening being formed in a first one of said three head support cushion components, second and third ones of said three head support cushion components being detachably affixed to said first head support cushion component so as to define portions of said breathing passage.

3. The body support platform of claim 2, wherein said second and third head support cushion components are detachably affixed to said first head support cushion component by hook-and-loop fasteners and said head support cushion is detachably affixed to said pair of cushion components by hook-and-loop fasteners.

4. The body support platform of claim 2, wherein said opening is an oval opening with major and minor axes, said second and third head support cushion components being detachably affixed to said first head support cushion component at substantially right angles to said major axis such that said breathing passage is substantially parallel to said minor axis.

5. The body support platform of claim 2, wherein said covering includes a second pair of overlapping flap portions forming a second pocket in said covering, said first and second pockets being open toward said hinge.

6. The body support platform of claim 5, wherein said cushion components comprise a pair of wedge-shaped resilient foam elements adapted to be inserted into and removed from said covering through said overlapping flap portions.

7. The body support platform of claim 5, wherein said cushion components comprise a pair of wedge-shaped resilient foam elements adapted to be inserted into and removed from said covering through said overlapping flap portions, handle means attached to said covering adjacent to said hinge for carrying said platform in its folded condition, a bolster for supporting the ankles of the user, said bolster and said three head support cushion components being received in said first and second pockets when said pair of cushion components are transported in said folded condition by said handle means.

8. The body support platform of claim 2, wherein each of said three head support cushion components has a covering, the covering of each of said three head support cushion components having a pair of overlapping flap portions, each such head support cushion component including a foam element adapted to be inserted into and removed from the covering thereof through the overlapping flap portions of a respective one of said three head support cushion components.

9. The body support platform of claim 8, wherein the foam element of said first head support cushion component comprises a pair of identical foam elements, each of said identical foam elements having a generally rectangular parallelepiped shape with a semi-oval cutout along a side thereof.

10. The body support platform of claim 2, wherein said three head support cushion components are in the shape of rectangular parallelepipeds.

11. The body support platform of claim 1, wherein the predetermined shape of the pair of cushion components in said folded condition is a rectangular parallelepiped, handle means attached to said covering adjacent to said hinge for carrying said platform in its folded condition.

12. The body support platform of claim 1, wherein said covering is one of a stretchable, cotton-based fabric, a rubberized fabric, leather and an elastic polymeric sheet material.

13. A body support platform comprising a body support cushion and a head support cushion detachably affixed to the body support cushion, said body support cushion comprising a pair of wedge-shaped cushion components, a covering for said cushion components, said covering comprising a hinge between said cushion components for folding said cushion components into a folded condition having a predetermined shape for transporting said platform and for holding said cushion components in an operative condition in an unfolded and fixed relationship relative to one another, said covering having a first and second pair of overlapping flap portions on opposite outward sides of said body support cushion when it is in said folded condition, said flap portions forming first and second pockets open toward said hinge, said head support cushion comprising three cushion components, an oval opening formed in a first one of said three cushion components for receiving the face of a user, second and third ones of said three cushion components being detachably affixed to said first cushion component so as to define a breathing passage communicating with said opening, said first, second and third cushion components being received in said pockets for transporting with said body support cushion in said folded condition.

14. The body support platform of claim 13, including a bolster for supporting the ankles of the user, said bolster being received in one of said pockets for transporting.

15. The body support platform of claim 13, wherein said covering is one of a stretchable, cotton-based fabric, a rubberized fabric and an elastic polymeric sheet material.

16. The body support platform of claim 13, including handle means attached to said covering adjacent to said hinge for carrying said platform in its folded condition.

17. The body support platform of claim 13, wherein each of said three cushion components has a covering, the covering for each of said three cushion components having a pair of overlapping flap portions, each such cushion component including a foam element adapted to be inserted into and removed from the covering thereof through the overlapping flap portions of said three cushion components.

18. The body support platform of claim 17, wherein said first cushion component comprises a pair of identical foam elements, each foam element having a rectangular parallelepiped shape with a semi-oval cutout along a side thereof.

19. The body support platform of claim 13, wherein said cushion components of said body support cushion comprise a pair of wedge-shaped resilient foam elements adapted to be inserted into and removed from said covering through said overlapping flap portions.

20. A body support platform comprising a head support cushion and a pair of cushion components, a covering for said pair of cushion components, said covering comprising a hinge between said cushion components for folding said cushion components into a folded condition having a predetermined shape for transporting said platform and for holding said cushion components in an operative condition in an unfolded relationship relative to one another, said covering having at least a first pair of overlapping flap portions forming a first pocket in said covering, said head support cushion comprising three head support cushion components, a first one of said head support cushion components having an opening therethrough for receiving the face of a user, a breathing passage in said head support cushion communicating with said opening for permitting the user to breathe, second and third ones of said three head support cushion components being detachably affixed to said first head support cushion component so as to define portions of said breathing passage.

21. The body support platform of claim 20, wherein said second and third head support cushion components are detachably affixed to said first head support cushion component by hook-and-loop fasteners and said head support cushion is detachably affixed to one of said pair of cushion components by hook-and-loop fasteners.

22. The body support platform of claim 20, wherein said opening is an oval opening with major and minor axes, said second and third head support cushion components being detachably affixed to said first head support cushion component at substantially right angles to said major axis such that said breathing passage is substantially parallel to said minor axis.

23. The body support platform of claim 20, wherein each of said three head support cushion components has a covering, the covering of each of said three head support cushion components having a pair of overlapping flap portions, each such head support cushion component including a foam element adapted to be inserted into and removed from the covering thereof through the overlapping flap portions of a respective one of said three head support cushion components.

24. A body support platform comprising a head support cushion and a body support cushion, said head support cushion being detachably affixed to said body support cushion and comprising three head support cushion components, a first one of said head support cushion components having an opening therethrough for receiving the face of a user, a breathing passage in said head support cushion communicating with said opening for permitting the user to breathe, second and third ones of said three head support cushion components being detachably affixed to said first head support cushion component so as to define portions of said breathing passage.

25. The body support platform of claim 24, wherein said body support cushion comprises a pair of cushion components, a covering for said pair of cushion components, said covering comprising a hinge between said cushion components for folding said cushion components into a folded condition having a predetermined shape for transporting said platform and for holding said cushion components in an operative condition in an unfolded relationship relative to one another, said covering having at least a first pair of overlapping flap portions forming a first pocket in said covering.

* * * * *